US011136530B2

(12) United States Patent
Seiler et al.

(10) Patent No.: US 11,136,530 B2
(45) Date of Patent: Oct. 5, 2021

(54) WASHING AGENT CONTAINING AMINE OXIDE AND SUGAR SURFACTANTS

(71) Applicant: Henkel AG & Co. KGaA, Duesseldorf (DE)

(72) Inventors: Martina Seiler, Duisburg (DE); Doris Dahlmann, Duesseldorf (DE); Anna Klemmer, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 16/223,267

(22) Filed: Dec. 18, 2018

(65) Prior Publication Data

US 2019/0185785 A1 Jun. 20, 2019

(30) Foreign Application Priority Data

Dec. 20, 2017 (DE) ..... 10 2017 223 459.8

(51) Int. Cl.

| | |
|---|---|
| ***C11D 1/75*** | (2006.01) |
| ***C11D 1/825*** | (2006.01) |
| ***C11D 1/83*** | (2006.01) |
| ***C11D 3/22*** | (2006.01) |
| ***C11D 3/33*** | (2006.01) |
| ***B08B 3/04*** | (2006.01) |
| ***C11D 11/00*** | (2006.01) |
| ***C11D 1/66*** | (2006.01) |
| *C11D 1/22* | (2006.01) |

(52) U.S. Cl.

CPC ..... *C11D 1/825* (2013.01); *C11D 1/662* (2013.01); *C11D 1/75* (2013.01); *C11D 11/0017* (2013.01); *C11D 1/22* (2013.01)

(58) Field of Classification Search

CPC .. C11D 1/12; C11D 1/662; C11D 1/75; C11D 1/825; C11D 3/22; C11D 3/33; B08B 3/04

See application file for complete search history.

(56) References Cited

U.S. PATENT DOCUMENTS

| | | | | |
|---|---|---|---|---|
| 4,780,250 | A * | 10/1988 | Urfer | C11D 1/662 510/292 |
| 5,415,801 | A * | 5/1995 | Ofosu-Asante | C11D 1/652 510/108 |
| 7,629,305 | B1 | 12/2009 | Szekeres et al. | |
| 2005/0282721 | A1* | 12/2005 | Szewczyk | C11D 1/94 510/237 |

FOREIGN PATENT DOCUMENTS

| | | | | |
|---|---|---|---|---|
| EP | 0075996 | A2 | 4/1983 | |
| WO | 9612000 | A1 | 4/1996 | |
| WO | WO 96/12000 | * | 4/1996 | C11D 1/65 |
| WO | 2009153184 | A1 | 12/2009 | |

* cited by examiner

*Primary Examiner* — Brian P Mruk
(74) *Attorney, Agent, or Firm* — Thomas G. Krivulka

(57) ABSTRACT

A washing agent, preferably a liquid washing agent, which contains at least one amine oxide together with at least one sugar surfactant. For example, at least one glucamide, preferably a fatty acid-N-alkyl glucamide, and/or at least one alkyl polyglycoside, having improved cleaning performance, in particular against fat-containing stains. The invention also relates to methods for washing textiles using the described washing agents and to the uses thereof.

9 Claims, 2 Drawing Sheets

WASHING AGENT CONTAINING AMINE OXIDE AND SUGAR SURFACTANTS

FIELD OF THE INVENTION

The present invention relates to a washing agent, preferably a liquid washing agent, which contains at least one amine oxide together with at least one sugar surfactant, for example at least one glucamide, preferably a fatty acid-N-alkyl glucamide, and/or at least one alkyl polyglycoside, having improved cleaning performance, in particular against fat-containing stains. The invention also relates to methods for washing textiles using the described washing agents and to the uses thereof.

BACKGROUND OF THE INVENTION

The use of various surfactants in washing agents is established in the prior art. Said surfactants are used as washing active substances to increase the solubility in water of fat and dirt particles which adhere to the laundry. Since insufficient cleaning performance is unsatisfactory and leads to customer dissatisfaction, a general aim is to further optimize the cleaning performance of washing agents.

BRIEF SUMMARY OF THE INVENTION

The problem addressed by the present invention is therefore that of providing a washing agent having improved cleaning performance, in particular on fat-containing stains.

It has been surprisingly found that the cleaning performance of washing agents, in particular with respect to their cleaning performance on fat-containing stains, is significantly improved if the washing agent contains, in addition to other surfactant components, amine oxide combined with sugar surfactants, such as glucamide and/or alkyl (poly) glycoside.

In a first aspect, the present invention therefore relates to washing agents, preferably liquid washing agents, containing a surfactant mixture, the surfactant mixture containing, in each case based on the total weight of the washing agent:

a) 0.1 wt. % to 30 wt. %, preferably 0.1 to 10 wt. %, of at least one amine oxide;

and b) 0.1 wt. % to 30 wt. %, preferably 0.1 to 10 wt. %, of at least one sugar surfactant, preferably a glucamide and/or an alkyl (poly)glycoside.

In another aspect, the present invention relates to the use of a washing agent according to the invention for washing textiles.

In another aspect, the present invention relates to a method for cleaning textiles, characterized in that a washing agent according to the invention, preferably a liquid washing agent is used in at least one method step.

In another aspect, the present invention relates to the use of at least one amine oxide in combination with at least one sugar surfactant for improving the cleaning performance, in particular on fat-containing stains, of a washing agent according to the invention.

These and other aspects, features, and advantages of the invention will become apparent to a person skilled in the art through the study of the following detailed description and claims. Any feature from one aspect of the invention can be used in any other aspect of the invention. Furthermore, it will readily be understood that the examples contained herein are intended to describe and illustrate but not to limit the invention and that, in particular, the invention is not limited to these examples. Unless indicated otherwise, all percentages indicated are percent by weight based on the total weight of the agent or composition. Numerical ranges that are indicated in the format "from x to y" include the cited values. If several preferred numerical ranges are indicated in this format, it is self-evident that all ranges that result from the combination of the various endpoints are also included.

DETAILED DESCRIPTION OF THE INVENTION

Figure 1:
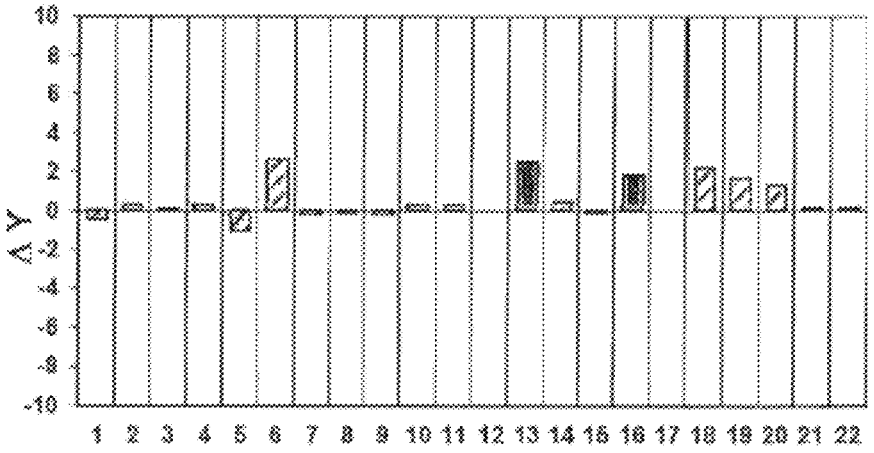
FIG. 1 shows the results of a washing test comparing stain sets containing amine oxide with stain sets not containing amine oxide.

"At least one", as used herein, refers to 1, 2, 3, 4, 5, 6, 7, 8, 9 or more. In connection with components of the compositions described herein, this information does not refer to the absolute amount of molecules, but to the type of the component. "At least one anionic surfactant" therefore signifies, for example, one or more different anionic surfactants, which is to say one or more different types of anionic surfactants. Together with stated amounts, the stated amounts refer to the total amount of the correspondingly designated type of component.

"Roughly," "approximately" or "about," as used herein in reference to a numerical value, refer to the corresponding numerical value ±10%, preferably ±5%.

The washing agents described herein may be washing agents for textiles or natural fibers. Within the scope of the invention, the washing agents also include auxiliary washing agents, which are added to the actual washing agent when washing textiles manually or using a machine in order to achieve an additional effect or in order to reinforce an effect. Furthermore, within the scope of the invention, washing agents also include textile pre-treatment and post-treatment agents, i.e. agents with which the piece of laundry comes into contact before it is actually washed, for example in order to loosen stubborn dirt, and also agents which impart other desirable properties to the laundry, for example softness to touch, crease resistance or low static charge, in a step that comes after the actual textile washing process. The agents mentioned last include, inter alia, softeners. In preferred embodiments, however, the agent is a textile washing agent.

The compositions described herein comprise at least one amine oxide, but may also comprise a plurality of amine oxides. In principle, all amine oxides found in the prior art for these purposes, i.e. compounds having the formula $R^1R^2R^3NO$, in which each $R^1$, $R^2$ and $R^3$, independently of the others, is an optionally substituted C1-C30 hydrocarbon chain, can be used in this regard. The $R^1$, $R^2$ and $R^3$ functional groups are preferably, independently of one another, an optionally substituted, aliphatic C1-C30 hydrocarbon functional group. Cyclic amine oxides in which the $R^1$ and $R^2$ functional groups form, together with the nitrogen atom, a ring (preferably a six-membered ring), for example N-methylmorpholine N-oxide, are also suitable according to the invention. Amine oxides that are particularly preferably used are those in which $R^1$ is C12-C18 alkyl or hydroxyalkyl and $R^2$ and $R^3$ are each independently a substituted, for example substituted with hydroxy groups, or unsubstituted C1-C4 alkyl, in particular C12-C18 alkyl dimethyl amine oxide and N—C12-C18 alkyl-N,N-di(C1-C4-hydroxyalkyl) amine oxide. Examples of representatives of suitable amine oxides are N-coconut alkyl-N,N-dimethyl amine oxide, N-tallow alkyl-N,N-dihydroxyethyl amine oxide, myristyl/cetyl dimethyl amine oxide or lauryl dimethyl amine oxide. Suitable amine oxides are commercially available from Stepan Company or Clariant, for example under the trade names Ammonyx, for example Ammonyx CSO, and Genaminox, for example Genaminox LA.

The compositions described herein additionally contain at least one sugar surfactant. The term "sugar surfactant" is used herein to refer to surfactants derived from sugars and derivatives thereof, such as polyols, saccharic acids, amides, etc. The term as used herein includes in particular:

- alkyl (poly)glycosides (APG) and addition products of alkylene oxide(s), in particular propylene oxide/ethylene oxide, with alkyl (poly)glycosides;
- polyol fatty acid esters;
- sugar fatty acid esters and addition products of alkylene oxide(s), in particular propylene oxide/ethylene oxide, with sugar fatty acid esters;
- fatty acid-N-alkyl polyhydroxyamides, in particular fatty acid-N-alkyl glucamides; and
- N-alkyl glyconamides, in particular N-alkyl gluconamides.

The sugar surfactant can, for example, be a glucamide, in particular a fatty acid-N-alkyl glucamide, i.e. an amide of fatty acids with the amines derived from sugars. Compounds of this kind are usually obtained by the reductive amination of a reducing sugar with ammonia, an alkyl amine or an alkanol amine, and subsequent acylation with a fatty acid, a fatty acid ester or a fatty acid chloride. Examples of suitable compounds satisfy the formula $R^6C(O)NR^7Z$, in which $R^6$ is a linear or branched, saturated or unsaturated alkyl group having 7 to 21 carbon atoms, Z is a polyhydroxy hydrocarbon group having at least three hydroxyl or alkoxy groups, and $R^7$ is a C1-C8 alkyl, a group of formula $—(CH_2)_xNR^8R^9$ or $R^{10}O(CH_2)_n—$, where $R^8$ and $R^9$ signify C1-C4 alkyl or C2-C4 hydroxyalkyl, $R^{10}$ signifies C1-C4 alkyl, n signifies a number from 2 to 4 and x signifies a number from 2 to 10. Particularly preferred are those compounds in which $R^6$ is C7-C17 alkyl, preferably linear and saturated, $R^7$ is methyl and Z is a glucose-derived functional group of formula $—CH_2—(CHOH)—(CHOH)—(CHOH)—CHOH)—CH_2OH$. C12-C18 acyl-N-methyl glucamides, for example C11 acyl-N-methyl glucamide, are particularly preferred. Suitable glucamides are commercially available under the trade name Glucopure, such as GlucoPure Wet®, from CLARIANT, for example.

N-alkyl glyconamides, in particular N-alkyl gluconamides, i.e. amides of alkylamines with the acids derived from sugars, are additionally suitable. Exemplary compounds satisfy the formula $R^6NR^7C(O)Z$, where $R^6$, $R^7$ and Z are defined as above, where $R^7$ can also be H and where not just Z alone, but also the C(O)Z group overall can be a functional group derived from a sugar, for example glucose, for example $—C(O)—(CHOH)—(CHOH)—(CHOH)—CHOH)—CH_2OH$. Examples of suitable compounds are N—C8-C18-alkyl-D-gluconamides, for example N-octyl-, N-decyl- and N-dodecyl-D-gluconamides and the corresponding N,N-dialkyl-D-gluconamides, in particular N—C8-C18 alkyl-N-methyl-D-gluconamides.

In various embodiments of the invention, the sugar surfactant is an alkyl (poly)glycoside, for example selected from compounds of formula:

$$R^5O\text{-}[G]_p,$$

in which $R^5$ represents a linear or branched alkyl having 4 to 26, preferably 8 to 20, more preferably 8 to 18, 8 to 10 or 12 to 16 carbon atoms, G represents a sugar residue having 5 or 6 carbon atoms and p represents numbers from 1 to 100, preferably 1 to 10.

G represents residues of sugars having 5 (pentoses) or 6 (hexoses) carbon atoms, it being possible for the sugars to be kentoses or aldoses. Preferred monosaccharides include, but are not limited to, glucose, galactose, fructose, mannose or ribose, in particular glucose. In addition to the monosaccharides, however, G can also represent sugar derivatives, in particular sugar alcohols, saccharic acids, amino sugars (glycosamines) or thiosugars. Sugar alcohols are obtained from the corresponding monosaccharide by reduction of the aldehyde or ketone function, for example sorbitol (glucitol) is obtained from glucose and mannitol is obtained from mannose. Saccharic acids are obtained from the corresponding monosaccharide by oxidation of the aldehyde function (aldonic acids) or of a terminal hydroxyl function (uronic acids) or both (aldaric acids), for example gluconic acid, glucuronic acid or glucaric acid is obtained from glucose. Amino sugars are obtained by substitution of a hydroxyl function by an amino function. A preferred example is glucosamine. Thiosugars are obtained by the substitution of a hydroxyl function by a thiol function. An example is thioglucose.

It is self-evident that, even if the sugars and sugar derivatives are described as such above, these are found as sugar residues in the alkyl (poly)glycosides of the above-mentioned formula and the $R^5$ functional group substitutes a hydrogen atom in the corresponding sugar or sugar derivative.

The degree of oligomerization p can be from 1 to 100, preferably 1 to 10, it being possible for each G independently to represent a simple sugar. If p is 2 or more, the different G units are preferably bonded to one another by means of glycosidic bonds. It may be preferable for the $R^5$ functional group to be bonded to a terminal sugar residue, but it may also be bonded to a non-terminal sugar unit in a corresponding oligomer.

If p=2, the sugar residue is a disaccharide residue. For example, one G may be glucose and the second G may be fructose and thus form sucrose (α-D-glucopyranosyl-(1-2)-β-D-fructofuranoside). However, it is preferred for all G in one molecule to be the same simple sugar, for example glucose. Examples of suitable disaccharides are, without limitation, maltose (α-D-glucopyranosyl-(1→4)-α-D-glucopyranose), isomaltose (α-D-glucopyranosyl-(1→6)-α-D-glucopyranose) and lactose (β-D-galactopyranosyl-(1→4)-D-glucopyranose).

If p=3, the sugar residue is a trisaccharide residue. Examples of suitable trisaccharides include, but are not limited to, raffinose, panose, and in particular maltotriose.

If p=4, the sugar residue is a tetrasaccharide residue, particularly preferably is maltotetraose.

If p=5 or more, the units are preferably glucose units, in particular those which are 1,4-glycosidically linked.

In all embodiments in which p is 2 or more, single, multiple or all sugar units can be substituted by the corresponding above-defined sugar derivatives. For example, aminoglycosides and thioglycosides in which the bond to the nearest unit is carried out via the nitrogen atom or the sulfur atom can be used.

Particularly preferred alkyl (poly)glycosides are derived from glucose and can be described by the formula:

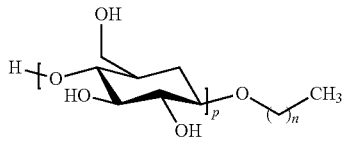

in which n represents 7 to 15, in particular 7 to 9 or 11 to 15 and p represents numbers from 1 to 100, preferably 1 to 10.

The degree of oligomerization p in the above-mentioned formulae is preferably <8, more preferably <6, even more preferably <4 and in particular <2. Particularly preferred are surfactants in which p represents numbers from 1.4 to 1.8. These fractional degrees of oligomerization are achieved by mixtures which contain varying amounts of surfactants of the above formulae, in which p represents an integer, preferably 1, 2, 3 or 4, for the single molecule.

Examples of particularly suitable surfactants include, without limitation:

n-decyl- or n-dodecyl-β-D-maltoside;

n-octyl-, 2-ethylhexyl-, n-decyl- or n-dodecyl-β-D-glucoside; and n-octyl-, 2-ethylhexyl-, n-decyl- or n-dodecyl-α-D-glucoside.

Washing agents, preferably liquid washing agents, according to the invention may contain C8-16, in particular C8-10 or C12-16 alkyl oligo(1,4) glucoside, for example. Suitable alkyl (poly)glycosides are available for example under the trade names Plantacare® or Plantaren® or Glucopon® from BASF (BASF SE, DE) and include, inter alia, Plantacare® 220 UP (APG 220 UP) and Plantaren® 1200 UP NP (APG 600 UP) or Glucopon® 425N, Glucopon® 215 UP or Glucopon® 600 UP.

In preferred embodiments, the agents described herein contain at least one amine oxide, for example a hydroxyamine oxide, and at least one alkyl (poly)glycoside, as defined above, in particular an alkyl polyglucoside. Alternatively or additionally, the agents may also contain a glucamide, as defined above.

In various embodiments of the invention, the surfactant mixture contains from 0.1 wt. % to 10 wt. % amine oxide, preferably 1 to 10 wt. %, more preferably 1.5 to 8 wt. %, and 0.1 wt. % to 10 wt. %, preferably 1 to 10 wt. %, more preferably 1.5 to 8 wt. %, sugar surfactant, in each case based on the total weight of the washing agent.

In various embodiments of the invention, the washing agents, preferably liquid washing agents, have a total surfactant content of from 2 to 60 wt. %, preferably 5 to 50 wt. %, more preferably 10 to 40 wt. %, most preferably 14 to 30 wt. %. "Total surfactant content" refers to the sum of all compounds used having surfactant properties. Any soaps that are present are likewise considered to be covered by the term "anionic surfactants" and are taken into account in the total surfactant content.

"Soaps" as used herein denote the water-soluble metal, ammonium or alkanolammonium salts, in particular the sodium or potassium salts, of saturated and unsaturated higher fatty acids, of resin acids of rosin (yellow resin soap) and of naphthenic acids, which are used as solid or semisolid mixtures mainly for washing and cleaning purposes.

In addition to the above-mentioned surfactants, the washing agent may contain additional anionic or non-ionic surfactants. Suitable surfactants are known in the prior art.

As the anionic surfactants, in particular those of the sulfate and sulfonate type may be used, preferably alkylbenzene sulfonates, olefin sulfonates, i.e. mixtures of alkene and hydroxyalkane sulfonates, and disulfonates, as are obtained, for example, from monoolefins having 12 to 18 carbon atoms and a terminal or an internal double bond by sulfonation with gaseous sulfur trioxide and subsequent alkaline or acid hydrolysis of the sulfonation products, as well as alkyl sulfates and alkyl ether sulfates. Alkane sulfonates having 12 to 18 carbon atoms and the esters of α-sulfofatty acids (ester sulfonates), for example the α-sulfonated methyl esters of the hydrogenated coconut, palm kernel or tallow fatty acids, are also suitable.

Alkylbenzene sulfonates are preferably selected from linear or branched alkylbenzene sulfonates of formula:

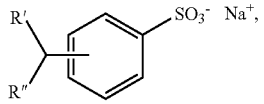

in which R' and R" are, independently, H or alkyl, and together contain 9 to 19, preferably 9 to 15, and in particular 9 to 13, carbon atoms. A more particularly preferred representative is sodium dodecylbenzene sulfonate.

The salts of the sulfuric acid half-esters of fatty alcohols having 12 to 18 carbon atoms, for example from coconut fatty alcohol, tallow fatty alcohol, lauryl, myristyl, cetyl or stearyl alcohol, or of oxo alcohols having 10 to 20 carbon atoms and the half-esters of secondary alcohols having this chain length are preferred as alk(en)yl sulfates. From a washing perspective, the alkyl sulfates having 12 to 16 carbon atoms and alkyl sulfates having 12 to 15 carbon atoms as well as alkyl sulfates having 14 and 15 carbon atoms are preferred.

The secondary alkane sulfonates are also particularly suitable. "Secondary", as used herein, refers to the generally known chemical meaning of this term and indicates that the carbon atom to which the sulfonate group is covalently bonded additionally has two covalent bonds to two organic (alkylic) functional groups, i.e. carbon atoms, and one covalent bond to a hydrogen atom. Together with the carbon atom to which they are bonded, the two organic (alkylic) functional groups form a linear or branched alkyl having 1 to 50 carbon atoms.

In various embodiments of the invention, secondary alkane sulfonate is one of formula:

$$R^1CH(SO_3^-X^+)R^2,$$

where $R^1$ and $R^2$ are each independently a linear or branched alkyl having 1 to 20 carbon atoms and form, together with the carbon atom to which they are bonded, a linear or branched alkyl, preferably having 10 to 30 carbon atoms, preferably having 10 to 20 carbon atoms and $X^+$ is selected from the group comprising $Na^+$, $K^+$, $NH_4^+$½ $Zn^{2+}$, ½ $Mg^{2+}$, ½ $Ca^{2+}$, ½ $Mn^{2+}$ and mixtures thereof, preferably $Na^+$. Particularly preferred are secondary alkane sulfonates of formula:

$$H_3C—(CH_2)_n—CH(SO_3^-X^+)—(CH_2)_m—CH_3,$$

where m and n are, independently of each other, an integer between 0 and 15. Preferably, m and n are, independently of each other, an integer between 7 and 15 and preferably between 11 and 14. $X^+$ is further selected from the group comprising $Na^+$, $K^+$, $NH_4^+$, ½ $Zn^{2+}$, ½ $Mg^{2+}$, ½ $Ca^{2+}$, ½ $Mn^{2+}$ and mixtures thereof, preferably $Na^+$.

Additional suitable anionic surfactants are those of the sulfate type and in this case in particular the alkyl ether sulfates.

Preferred alkyl ether sulfates are those of the following formula:

$$R^3—O-(AO)_n—SO_3^-X^+,$$

where $R^3$ is a linear or branched alkyl having 5 to 30 carbon atoms, preferably having 7 to 25 carbon atoms and more preferably having 10 to 19 carbon atoms. Moreover, in the above formula, AO represents an ethylene oxide (EO) or propylene oxide (PO) group, preferably an ethylene oxide (EO) group and n represents an integer from 1 to 50, preferably from 1 to 20 and more preferably from 2 to 10. $X^+$ is any cation and is preferably selected from the group comprising $Na^+$, $K^+$, $NH_4^+$½ $Zn^{2+}$, ½ $Mg^{2+}$, ½ $Ca^{2+}$, ½ $Mn^{2+}$ and mixtures thereof, particularly preferably $Na^+$.

In the above formula, $R^3$ represents a linear or branched, substituted or unsubstituted alkyl functional group. In a preferred embodiment of the present invention, $R^3$ is a linear or branched, preferably unsubstituted, alkyl functional group having 5 to 30 carbon atoms, preferably having 7 to 25 carbon atoms and in particular having 10 to 19 carbon atoms. Preferred $R^3$ functional groups are selected from decyl, undecyl, dodecyl, tridecyl, tetradecyl, pentadecyl, hexadecyl, heptadecyl, octadecyl, nonadecyl functional groups and mixtures thereof, the representatives having an even number of carbon atoms being preferred. Particularly preferred $R^3$ functional groups are derived from fatty alcohols having 12 to 18 carbon atoms, for example from coconut fatty alcohol, tallow fatty alcohol, lauryl, myristyl, cetyl or stearyl alcohol or from oxo alcohols having 10 to 19 carbon atoms.

AO is an ethylene oxide (EO) or propylene oxide (PO) group, preferably an ethylene oxide group. The index m is an integer from 1 to 50, preferably 2 to 20, and more preferably 2 to 10. In particular, m is 3, 4, 5, 6 or 7. The agent according to the invention may contain mixtures of non-ionic surfactants which have different degrees of ethoxylation.

The alkyl ether sulfate is preferably one of formula:

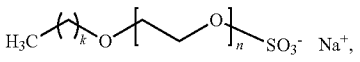

where k=11 to 19 and n=2, 3, 4, 5, 6, 7 or 8. Very particularly preferred representatives are Na fatty alcohol ether sulfates having 12 to 18 carbon atoms and 2 EO (k=11 to 13 and n=2). The given degree of ethoxylation represents a statistical average that can correspond to an integer or a fractional number for a specific product. The given degrees of alkoxylation generally represent statistical averages that can correspond to an integer or a fractional number for a specific product. Preferred alkoxylates/ethoxylates have a narrowed homolog distribution (narrow range ethoxylates, NRE).

Further suitable anionic surfactants are the bisalkyl sulfosuccinates, for example.

Preferred anionic surfactants are the alkylbenzene sulfonates and the alkyl ether sulfates, and in particular combinations of the two. It is self-evident that a plurality of different representatives of the particular surfactant class may also be used in each case. In the context of the present invention, soaps are considered to be anionic surfactants, i.e. the given amounts of anionic surfactants include any soaps that are present.

All of the above-described anionic surfactants can include any cation in order to equalize the negative charge of the sulfonate group. The cation is preferably selected from the group comprising $Na^+$, $K^+$, $NH_4^+$½ $Zn^{2+}$, ½ $Mg^{2+}$, ½ $Ca^{2+}$, ½ $Mn^{2+}$ and mixtures thereof, particularly preferably $Na^+$.

The anionic surfactants are contained in the agents according to the invention preferably in amounts of at least 20 wt. %, based on the total weight of the agent. Preferred amount ranges are from 20 to 65, more preferably 20 to 55 wt. %. Most preferred are concentrations in the range of from 20 to 35 wt. %. The given amounts relate to the total amounts of anionic surfactants contained in the agent.

The agent may additionally contain other non-ionic surfactants, i.e. in addition to the above-described alkyl (poly) glycosides and amine oxides.

The additional non-ionic surfactants can be selected from:

- alkyl ethers, in particular fatty alcohol alkoxylates, such as fatty alcohol ethoxylates;
- (alkoxylated) triglycerides;
- (alkoxylated) fatty acid alkyl esters;
- hydroxy mixed ethers;
- sorbitan fatty acid esters and addition products of alkylene oxide(s), in particular propylene oxide/ethylene oxide, with sorbitan fatty acid esters such as polysorbates (ethoxylated polysorbates); and
- addition products of alkylene oxide(s), in particular propylene oxide/ethylene oxide, with fatty acid alkanolamides and fatty amines.

In various embodiments, the non-ionic surfactants may comprise at least one alkyl ether. In a preferred embodiment of the invention, the agents described herein contain, as the non-ionic surfactant, at least one fatty alcohol alkoxylate having the following formula:

$$R^4—O-(AO)_m—H,$$

where $R^4$ is a linear or branched alkyl functional group, AO is an ethylene oxide (EO) or propylene oxide (PO) group and m is an integer from 1 to 50. In the above formula, $R^4$ represents a linear or branched, substituted or unsubstituted alkyl functional group. In a preferred embodiment of the present invention, $R^1$ is a linear or branched, preferably unsubstituted, alkyl functional group having 5 to 30 carbon atoms, preferably having 7 to 25 carbon atoms and in particular having 10 to 19 carbon atoms. Preferred $R^1$ functional groups are selected from decyl, undecyl, dodecyl, tridecyl, tetradecyl, pentadecyl, hexadecyl, heptadecyl, octadecyl, nonadecyl functional groups and mixtures thereof, the representatives having an even number of carbon atoms being preferred. Particularly preferred $R^4$ functional groups are derived from fatty alcohols (fatty alcohol alkoxylates) having 12 to 19 carbon atoms, for example from coconut fatty alcohol, tallow fatty alcohol, lauryl, myristyl, cetyl or stearyl alcohol or from oxo alcohols having 10 to 19 carbon atoms.

AO is an ethylene oxide (EO) or propylene oxide (PO) group, preferably an ethylene oxide group. The index m is an integer from 1 to 50, preferably 2 to 20, and more preferably 2 to 10. In particular, m is 3, 4, 5, 6 or 7. The agent according to the invention may contain mixtures of non-ionic surfactants which have different degrees of ethoxylation.

In summary, particularly preferred fatty alcohol alkoxylates are those of formula:

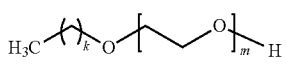

where k=9 to 17 and m=3, 4, 5, 6 or 7. More particularly preferred representatives are fatty alcohols having 10 to 18 carbon atoms and 5 or 7 EO (k=11 to 17 and m=5 or 7).

Fatty alcohol ethoxylates of this kind having 7 EO are available under the commercial names Dehydol® LT7 (BASF), Lutensol® A07 (BASF), Lutensol® M7 (BASF) and Neodol® 45-7 (Shell Chemicals).

Additional non-ionic surfactants of this kind, in particular the above-mentioned fatty alcohol ethoxylates, are preferably contained in the agent in amounts of from 0 to 25 wt. %, preferably 2 to 20 wt. %, more preferably 4 to 15 wt. %.

The agent can additionally contain other surfactants, for example amphoteric or zwitterionic surfactants or even cationic surfactants. In particular the betaines are of significance here. However, it may be preferable for the agent to contain no additional amphoteric, zwitterionic or cationic surfactants.

In various embodiments of the invention, hydrotropic substances may be used in addition to the surfactant systems described herein for further improving the stability of the agent. The term "hydrotropic substance", as used in connection with the present invention, relates to additives or solvents which cause the water solubility of poorly soluble (hydrophobic) organic compounds to increase. In this case, the poorly soluble substance is added to a second component (i.e. the hydrotropic substance), which itself is not a solvent. Hydrotropic substances of this kind have hydrophilic and hydrophobic structural units (such as surfactants) but without the tendency to form aggregates in water (in contrast to surfactants). In various embodiments, these hydrotropic substances do not have micelle-forming activity or the critical micelle-forming concentration (CMC) is greater than $10^{-4}$ mol/l, preferably greater than $10^{-3}$ mol/1 and more preferably 10' mol/1. In line with the general understanding in the prior art, the "critical micelle-forming concentration" is the concentration of the corresponding substance above which said substance starts to form micelles and every additional molecule which is added to the system is converted into the micelles. The hydrotropic substances used typically have a molecular weight <10,000 g/mol, preferably <2,500 g/mol, more preferably <1,000 g/mol and most preferably <500 g/mol. For example, said substances may be selected from short-chain mono-, di-, tri-, tetra- or pentaalkylbenzene sulfonates, in particular C1-6 alkylbenzene sulfonates, it being possible for the alkyl groups to be linear or branched, including but not limited to cumene sulfonate, tuolene sulfonate and/or xylene sulfonate as well as butyl glycol, propylene glycol, 3-methoxy-3-methyl-1-butanol, 2,2-dimethyl-4-hydroxymethyl-1,2-dioxolane, propylene carbonate, butyl lactate, 2-isobutyl-2-methyl-1,3-dioxolane-4-methanol or mixtures thereof. The hydrotropic substance is preferably cumene sulfonate. The hydrotropic compounds are preferably used in a range of from 0.1 to 5 wt. %, more preferably 1 to 2 wt. %, based on the total weight of the agent.

In addition, the washing agent may contain additional ingredients which further improve the practical and/or aesthetic properties of the washing agent. Within the scope of the present invention, the washing agent preferably additionally contains one or more substances from the group of dye transfer inhibitors (DTI), anti-redeposition agents, soil release polymers (SRP), enzymes, builders/complexing agents, bleaching agents, electrolytes, perfumes, perfume carriers, fluorescing agents, dyes, suds suppressors, silicone oils, graying inhibitors, anti-shrink agents, crease protection agents, antimicrobial active ingredients, germicides, fungicides, antioxidants, preservatives, corrosion inhibitors, antistatic agents, bittering agents, ironing aids, repellents and impregnating agents, swelling agents and non-slip agents, softening components, pH adjusters and UV absorbers.

In order to effectively prevent dye from dissolving or transferring to other textiles during washing and/or cleaning of dyed textiles, the composition according to the invention may contain a dye transfer inhibitor. It is preferable for the dye transfer inhibitor to be a polymer or a copolymer of cyclic amines such as vinylpyrrolidone and/or vinylimidazole. Suitable polymers include polyvinylpyrrolidone (PVP), polyvinylimidazole (PVI), copolymers of vinylpyrrolidone and vinylimidazole (PVP/PVI), polyvinylpyridine-N-oxide, poly-N-carboxymethyl-4-vinylpyridium chloride and mixtures thereof. Polyvinylpyrrolidone (PVP), polyvinylimidazole (PVI) or copolymers of vinylpyrrolidone and vinylimidazole (PVP/PVI) are particularly preferably used as a dye transfer inhibitor.

In particular polycarboxylates can be used as anti-redeposition agents. Suitable materials can be obtained by the polymerization or copolymerization of unsaturated carboxylic acid monomers, for example acrylic acid, maleic acid (or maleic anhydride), fumaric acid, itaconic acid, aconitic acid, mesaconic acid, citraconic acid and methylmalonic acid. Particularly preferred are acrylate polymers and acrylic acid/maleic acid copolymers.

Suitable SRPs, anti-redeposition agents and DTIs are also described, for example, in the international patent publication WO 2009/153184 A1 on pages 25-39 under the headings "Dye transfer inhibitors," "Anti-redeposition agents" and "Soil release polymers." The disclosure of said document in respect of the mentioned polymers is included in its entirety in the present application by way of reference.

The liquid washing agents described herein additionally contain preferably at least one enzyme. The at least one enzyme can be any enzyme which is known in the prior art, can initiate a catalytic activity in a washing or cleaning agent and includes, without being limited thereto, proteases, amylases, lipases, cellulases, hemicellulases, mannanases, pectin-cleaving enzymes, tannanases, xylanases, xanthanases, ß-glucosidases, carrageenases, perhydrolases, oxidases, oxidoreductases and mixtures thereof, for example. In a preferred embodiment, the at least one enzyme is selected from the group consisting of proteases, amylases, lipases, cellulases and mixtures thereof. In principle, these enzymes are of natural origin; starting from the natural molecules, however, improved variants are available for use in washing or cleaning agents, which variants are correspondingly preferably used.

The washing agents, preferably liquid washing agents, may contain the enzyme in total amounts established in the prior art. The at least one enzyme can thus be contained in a total amount of from $1\times10^{-8}$ to 5 wt. % based on the active protein or also in a total amount of from 0.001 to 3 wt. %, or 0.01 to 1.5 wt. % or 0.05 to 1.25 wt. %. The amounts stated should be understood to mean that each enzyme contained can be contained in the mentioned amounts. The enzymes are preferably used as liquid enzyme formulation(s).

Enzymes of this kind, which are present in a washing or cleaning agent, facilitate the cleaning performance of the agent on particular stains or spots. An agent according to the invention particularly preferably contains a plurality of enzymes, it being possible for the enzymes to belong to the same or different enzyme classes. The enzymes particularly preferably have synergistic effects with respect to the action thereof against particular stains or spots, i.e. the enzymes contained in the composition assist one another in terms of the cleaning performance thereof.

All substances which destroy or absorb dyes by means of oxidation, reduction or adsorption, and thus decolorize materials, can be used as bleaching agents. These include, inter alia, hypohalite-containing bleaching agents, hydrogen peroxide, perborate, percarbonate, peracetic acid, diperoxyazelaic acid, diperoxydodecanedioic acid and oxidative enzyme systems. However, liquid washing agents are typically free of non-enzymatic bleaching agents.

In particular silicates, aluminum silicates (in particular zeolites), carbonates, phosphonates, organic di- and polycarboxylic acids or salts thereof and mixtures of these substances should be mentioned as builders which can be contained in the washing agent.

Organic builders which may be present in the washing agent are, for example, the polycarboxylic acids that can be used in the form of the sodium salts thereof, polycarboxylic acids being understood to mean those carboxylic acids that carry more than one acid function. For example, these are citric acid, adipic acid, succinic acid, glutaric acid, malic acid, tartaric acid, maleic acid, fumaric acid, saccharic acids, aminocarboxylic acids, and mixtures thereof. Preferred salts are the salts of polycarboxylic acids such as citric acid, adipic acid, succinic acid, glutaric acid, tartaric acid, saccharic acids, and mixtures thereof. Aminocarboxylic acids such as in particular ethylenediaminetetraacetic acid (EDTA), glutaminediacetic acid (GLDA) and methylglycinediacetic acid (MGDA) or even ethylenediaminedisuccinic acid (EDDS) or mixtures thereof, in particular mixtures containing EDTA and EDDS, are likewise suitable and preferred.

Polymeric polycarboxylates are also suitable as builders. These include the alkali metal salts of polyacrylic acid or of polymethacrylic acid, for example those having a relative molecular mass of from 600 to 750,000 g/mol.

Suitable polymers are in particular polyacrylates which preferably have a molecular mass of from 1,000 to 15,000 g/mol. From this group, the short-chain polyacrylates which have molar masses of from 1,000 to 10,000 g/mol and particularly preferably 1,000 to 5,000 g/mol can in turn be preferred owing to their superior solubility.

In addition, copolymeric polycarboxylates are suitable, in particular those of acrylic acid with methacrylic acid and of acrylic acid or methacrylic acid with maleic acid.

In order to improve the water solubility, copolymeric polycarboxylates which contain allyl sulfonic acids, such as allyloxybenzene sulfonic acid and methallyl sulfonic acid, as monomers can also be used as polymers. In various embodiments, sulfopolymers of this kind are particularly preferred.

In liquid washing agents, preferred soluble builders, for example citric acid, or acrylic polymers having a molar mass of from 1,000 to 5,000 g/mol, are used.

Citrate is particularly preferred. In various embodiments, the above-described water-soluble organic builders can be used in amounts of from 1 to 25 wt. %, preferably 1.5 to 20 wt. %, more preferably 2 to 15 wt. %, most preferably 2.5 to 10 wt. %, based on the total weight of the agent. In particular citrate is used in amounts of from 2.5 to 5 wt. %.

The washing agents can additionally contain phosphonates, for example HEDP (1-hydroxyethane-1,1-diphosphonic acid) or DTPMP (diethylenetriamine penta(methylene phosphonate), as builders and complexing agents. The phosphonates are used in various embodiments in amounts of up to 10 wt. %, preferably up to 5 wt. %, particularly preferably from 0.5 to 4 wt. %, based on the total weight of the agent.

Preferred washing agents, preferably liquid washing agents, preferably contain water as the main solvent. In this case, it is preferable for the washing agent to contain more than 5 wt. %, preferably more than 15 wt. % and particularly preferably more than 25 wt. % water, in each case based on the total amount of washing agent. Particularly preferred liquid washing agents contain, based on the weight thereof, 5 to 65 wt. %, preferably 10 to 60 wt. %, particularly preferably 25 to 55 wt. %, and in particular 30 to 50 wt. % water. Alternatively, the washing agents may be low-water to water-free washing agents, the water content in low-water washing agents being less than 20 wt. %, preferably less than 15 wt. %, more preferably less than 10 wt. % and most preferably less than 8 wt. %, in each case based on the total liquid washing agent. Water-free agents contain less than 5 wt. %, preferably less than 3 wt. %, more preferably less than 2, most preferably less than 1 wt. % water, based on the total weight of the agent.

In addition, non-aqueous solvents can be added to the washing agent. Suitable non-aqueous solvents include monovalent or polyvalent alcohols, alkanol amines or glycol ethers, if they can be mixed with water in the stated concentration range. Said solvents are different from the hydrotropic substances defined above. It may be preferable for the washing agent to contain a solvent of this kind in amounts of between 0.5 and 15 wt. %, based on the total washing agent.

The washing agents described herein, in particular the described low-water to water-free liquid washing agents, can be filled into a water-soluble wrapping and thus be a component of a water-soluble packaging. If the washing agent is packaged in a water-soluble wrapping, it is preferable for the water content to be less than 20 wt. %, preferably less than 15 or 10 wt. %, based on the total washing agent.

In addition to the washing agent, a water-soluble packaging contains a water-soluble wrapping. The water-soluble wrapping is preferably formed by a water-soluble film material.

Water-soluble packaging of this kind can be produced either by a vertical form fill seal (VFFS) method or by a thermoforming method.

The thermoforming method generally includes forming a first layer of a water-soluble film material in order to form convex portions for receiving a composition therein, filling the composition into the convex portions, covering the convex portions filled with the composition with a second layer of a water-soluble film material and sealing the first and second layers together at least around the convex portions.

The water-soluble wrapping is preferably formed of a water-soluble film material selected from the group consisting of polymers or polymer blends. The wrapping can be formed of one or of two or more layers of the water-soluble film material. The water-soluble film material of the first layer and of the additional layers, if present, can be the same or different.

The water-soluble packaging, comprising the washing agent and the water-soluble wrapping, can comprise one or more compartments. The liquid washing agent can be contained in one or more compartments, if present, of the water-soluble wrapping. The amount of liquid washing agent preferably corresponds to the full or half dose required for a wash cycle.

It is preferable for the water-soluble wrapping to contain polyvinyl alcohol or a polyvinyl alcohol copolymer.

Suitable water-soluble films for producing the water-soluble wrapping are preferably based on a polyvinyl alcohol or a polyvinyl alcohol copolymer of which the molecular weight is in the range of from 10,000 to 1,000,000 g/mol, preferably 20,000 to 500,000 g/mol, particularly preferably 30,000 to 100,000 g/mol and in particular 40,000 to 80,000 g/mol.

Polymers selected from the group comprising acrylic acid-containing polymers, polyacrylamides, oxazoline polymers, polystyrene sulfonates, polyurethanes, polyesters, polyether polylactic acid, and/or mixtures of the above polymers, can additionally be added to a film material suitable for producing the water-soluble wrapping.

In addition to vinyl alcohol, preferred polyvinyl alcohol copolymers comprise dicarboxylic acids as additional monomers. Suitable dicarboxylic acids are itaconic acid, malonic acid, succinic acid and mixtures thereof, itaconic acid being preferred.

In addition to vinyl alcohol, likewise preferred polyvinyl alcohol copolymers comprise an ethylenically unsaturated carboxylic acid, the salt thereof or the ester thereof. In addition to vinyl alcohol, polyvinyl alcohol copolymers of this kind particularly preferably contain acrylic acid, methacrylic acid, acrylic acid ester, methacrylic acid ester or mixtures thereof.

Suitable water-soluble films for use in the wrappings of the water-soluble packaging according to the invention are films sold by the company MonoSol LLC under the name M8630, C8400 or M8900, for example. Other suitable films include films with the name Solublon® PT, Solublon® GA, Solublon® KC or Solublon® KL from Aicello Chemical Europe GmbH or the films VF-HP from Kuraray.

The water-soluble packaging can have a substantially dimensionally stable sphere-shaped and cushion-shaped design with a circular, elliptical, quadratic or rectangular basic shape.

The water-soluble packaging can have one or more compartments for storing one or more agents. If the water-soluble packaging has two or more compartments, at least one compartment contains a liquid washing agent. Each of the additional compartments may contain a solid or a liquid washing agent.

The invention also relates to a method for cleaning textiles, which method is characterized in that an agent according to the invention is applied in at least one method step, and to the use of a washing agent according to the invention for washing textiles.

As already described above, the invention also relates to the use of at least one amine oxide in combination with at least one sugar surfactant, preferably a glucamide and/or alkyl polyglycoside, for improving the cleaning performance of a washing agent, in particular on fat-containing stains, the washing agent containing a surfactant mixture which contains, in each case based on the total weight of the washing agent:

a) 0.1 wt. % to 30 wt. % of at least one amine oxide; and b) 0.1 wt. % to 30 wt. % of at least one sugar surfactant.

In the washing process described herein, temperatures of 40° C. or less, for example 30° C. or less, are used in various embodiments of the invention. This temperature information relates to the temperatures used in the washing steps.

These embodiments include both manual and automatic methods, automatic methods being preferred. Methods for cleaning textiles are generally distinguished in that various substances that have a cleaning effect are applied to the item to be cleaned in a plurality of method steps and washed off after the contact time, or in that the item to be cleaned is treated with a washing agent or a solution or dilution of this agent in some other way. All conceivable washing methods can be enhanced in at least one of the method steps by the use of a washing agent according to the invention, and then constitute embodiments of the present invention. All elements, subjects and embodiments that are described for the agent according to the invention can also be applied to this subject of the invention. Therefore, at this juncture, reference is explicitly made to the disclosure at the corresponding point when it was indicated that this disclosure also applies to the above methods and uses according to the invention.

EXAMPLES

Example 1: Washing Agent Formulations

TABLE 1

Washing agent formulation, components in wt. % of the active substance

| Ingredient | Active substance (%) | E1 | E2 | E3 | E4 | E5 |
|---|---|---|---|---|---|---|
| Demineralized water | 100 | total to 100 | | | | |
| Propanediol-1,2 | 100 | 10.4 | 10.4 | 10.4 | 10.4 | 10.4 |
| Sodium hydroxide 50% | 50 | 2.75 | 2.75 | 2.75 | 2.75 | 2.75 |
| Boric acid | 100 | 1.5 | 1.5 | 1.5 | 1.5 | 1.5 |
| Water-free citrate | 100 | 2.9 | 2.9 | 2.9 | 2.9 | 2.9 |
| C12-18 fatty alcohol 7 EO | 100 | 5 | 5 | 5 | 5 | 5 |
| Alkylbenzene sulfonic acid | 96 | 3.9 | 3.9 | 3.9 | 3.9 | 3.9 |
| C12-18 soap | 100 | 2 | 2 | 2 | 2 | 2 |
| EDTA-Na4 liquid | 40 | 1 | 1 | 1 | 1 | 1 |
| Ethylenediaminedisuccinic acid | 37 | 1 | 1 | 1 | 1 | 1 |
| Sodium laureth sulfate | 70 | 14.7 | 14.7 | 14.7 | 14.7 | 14.7 |
| Sodium laureth sulfate | 81 | 3 | 3 | 3 | 3 | 3 |
| Ethoxylated polyethyleneimine | 80 | 2 | 2 | 2 | 2 | 2 |
| Ethanol 96 vol. % | 93 | 1 | 1 | 1 | 1 | 1 |
| Defoamer | 100 | 0.04 | 0.04 | 0.04 | 0.04 | 0.04 |
| Sodium formate | 40 | 0.3 | 0.3 | 0.3 | 0.3 | 0.3 |
| Optical brightener (Tinopal CBS-X) | 90 | 0.14 | 0.14 | 0.14 | 0.14 | 0.14 |
| Amylase | 100 | 0.5 | 0.5 | 0.5 | 0.5 | 0.5 |
| Cellulase | 100 | 0.17 | 0.17 | 0.17 | 0.17 | 0.17 |

TABLE 1-continued

| Washing agent formulation, components in wt. % of the active substance | | | | | | |
|---|---|---|---|---|---|---|
| Ingredient | Active substance (%) | E1 | E2 | E3 | E4 | E5 |
| Mannanase | 100 | 0.25 | 0.25 | 0.25 | 0.25 | 0.25 |
| Protease | 100 | 1.5255 | 1.5255 | 1.5255 | 1.5255 | 1.5255 |
| Pectinase | 100 | 0.1 | 0.1 | 0.1 | 0.1 | 0.1 |
| Perfume | 100 | 1.3 | 1.3 | 1.3 | 1.3 | 1.3 |
| Ammonyx CSO (amine oxide) | 30 | 4 | 4 | 4 | 4 | — |
| Genaminox LA (amine oxide) | 30 | — | — | — | — | 4 |
| Glucopure WET | 50 | 4.4 | — | — | — | 4.4 |
| Glucopon 425N | 50 | — | 4.4 | — | — | — |
| Glucopon 600 UP | 50 | — | — | 4.4 | — | — |
| Glucopon 215 UP | 63.5 | — | — | | 4.4 | — |
| Dye | t.g | | | 0.0022 | | |

Ammonyx CSO (C12-C18 amine oxide)
Genaminox LA (lauryldimethylamine oxide)
Glucopure WET (C8-10 methyl glucamide)
Glucopon 425N (15.0-25.0 wt. % C10-16 alkyl glycoside; 25.0-35.0 wt. % decyl octyl glycoside)
Glucopon 215 UP (C8-10 alkyl (poly)glycoside; active substance 62-65 wt. %)
Glucopon 600 UP (C10-16 alkyl (poly)glycoside; DP 1,4; active substance 50-53 wt. %)

Example 2: Washing Tests

In a washing test, various amine oxides (Ammonyx CSO, Genaminox LA) were compared with regard to their detergent power. The washing was carried out in US front-loading washing machines with a standard wash cycle. The result of the comparison of the formulations containing amine oxide with the formulations not containing amine oxide is shown (see FIG. 1 and FIG. 2).

Figure 2:
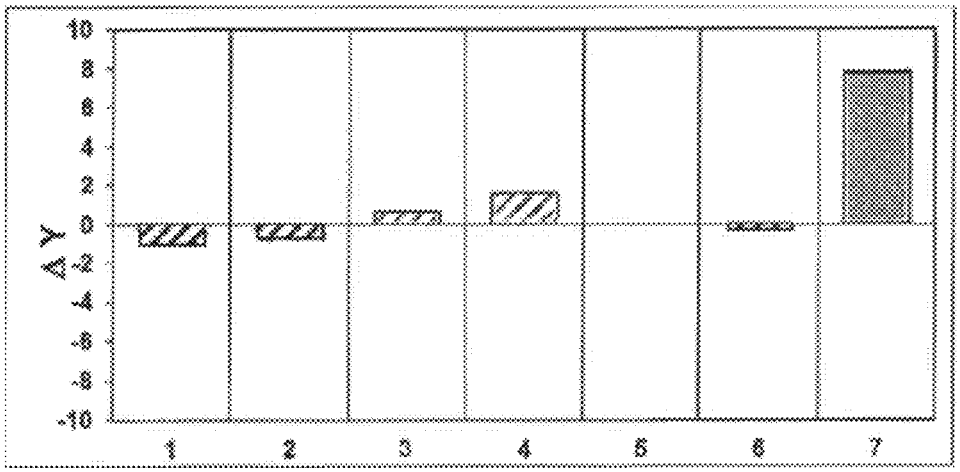
FIG. 2 shows the results of the comparison washing test containing an additional stain set.

The solid bars pointing upwards from FIG. 1 and FIG. 2 demonstrate significant advantages for the amine oxide-containing formulation. Hatched regions demonstrate tendential advantages for $\Delta Y>1$ and tendential disadvantages for $\Delta Y<-1$.

It is clear that the use of amine oxide on stains, in particular on the fat-containing stains such as taco fat, bacon fat and butter, achieves a significant improvement in washing performance.

REFERENCE LIST

FIG. 1 (ASTM stain set)
1. Blueberry
2. Coffee
3. Mustard (French's Mustard USA)
4. Spaghetti sauce
5. Tea
6. Grape juice (Welch's Grape Juice USA)
7. Wine
8. Animal blood
9. Black Todd Clay
10. Chocolate ice cream
11. Chocolate pudding (Hunt's Chocolate Pudding USA)
12. Grass
13. Bacon fat
14. Blue ballpoint pen
15. Black Charm Clay
16. Butter
17. Canola oil
18. Dirty engine oil
19. Rubbed in dirt (Great Value Gravy USA)
20. Make-up
21. Olive oil
22. Gravy FIG. 2 (additional stains)
1. Cranberry juice (Ocean Spray)
2. Tomato juice
3. Milk chocolate (Swiss Miss Chocolate with milk)
4. Balsamic vinaigrette (Newman's Balsamic)
5. Chili (Hormel)
6. BBQ sauce (Baby Ray's sauce)
7. Taco fat

What is claimed is:

1. A washing agent comprising a surfactant mixture, wherein the surfactant mixture contains, in each case based on the total weight of the washing agent:

a) 0.1 wt. % to 30 wt. % of at least one amine oxide selected from those of formula $R^1R^2R^3NO$, where each of $R^1$, $R^2$ and $R^3$ is, independently of the others, a substituted C1-C30 hydrocarbon chain;

b) 0.1 wt. % to 30 wt. % of at least one sugar surfactant comprising at least one alkyl (poly)glycoside;

c) at least one fatty alcohol alkoxylate having the following formula:

$$R^4—O-(AO)_m—H,$$

where $R^4$ is a linear or branched alkyl functional group, AO is an ethylene oxide (EO) or propylene oxide (PO) group and m is an integer from 1 to 50;

d) 0.05 wt. % to 10 wt. % of a hydrotropic substance selected from C1-6 alkylbenzene sulfonates;

e) 0.5 to 15 wt. % of at least one non-aqueous solvent selected from the group consisting of monovalent or polyvalent alcohols, alkanol amines or glycol ethers; and f) a plurality of enzymes comprising an amylase, a cellulase, a mannanase, a protease, and a pectinase.

2. The washing agent according to claim 1, characterized in that the washing agent contains the surfactant mixture in an amount from 2 to 60 wt. % based on the total weight of the washing agent.

3. The washing agent according to claim 1, characterized in that the washing agent additionally contains at least one additional component selected from the group consisting of dye transfer inhibitors, soil release polymers (SRP), anti-redeposition agents, builders, bleaching agents, electrolytes, perfumes, perfume carriers, fluorescing agents, dyes, hydrotropic substances, suds suppressors, silicone oils, graying inhibitors, anti-shrink agents, crease protection agents, antimicrobial active ingredients, germicides, fungicides, antioxidants, preservatives, corrosion inhibitors, antistatic agents, bittering agents, ironing aids, repellents and impregnating agents, swelling agents and non-slip agents, softening components, pH adjusters and UV absorbers.

4. A method for cleaning textiles, comprising a step wherein a washing agent according to claim 1 is contacted with textiles in a wash liquor.

5. The washing agent according to claim 1, characterized in that the sugar surfactant comprises an alkyl (poly)glucoside which is selected from compounds of formula $R^5O\text{-}[G]_p$, where $R^5$ is a linear or branched alkyl having 4 to 26 carbon atoms, G is a sugar residue having 5 or 6 carbon atoms and p is an integer from 1 to 100.

6. The washing agent according to claim 1, characterized in that the sugar surfactant comprises an alkyl (poly)glucoside which is selected from compounds of formula $R^5O\text{-}[G]_p$, where $R^5$ is a linear or branched alkyl having 4 to 16 carbon atoms, G is glucose and p is an integer from 1 to 10.

7. The washing agent according to claim 2, characterized in that the washing agent contains the surfactant mixture in an amount from 5 to 50 wt. % based on the total weight of the washing agent.

8. The washing agent according to claim 2, characterized in that the washing agent contains the surfactant mixture in an amount from 10 to 40 wt. % based on the total weight of the washing agent.

9. The washing agent according to claim 2, characterized in that the washing agent contains the surfactant mixture in an amount from 14 to 30 wt. % based on the total weight of the washing agent.

* * * * *